US005286007A

United States Patent [19]

Takagi

[11] Patent Number: 5,286,007

[45] Date of Patent: Feb. 15, 1994

[54] HEAT TREATMENT SYSTEM

[75] Inventor: Ryoji Takagi, Nagaokyo, Japan

[73] Assignee: Murata Manufacturing Co., Ltd., Japan

[21] Appl. No.: 875,376

[22] Filed: Apr. 29, 1992

[30] Foreign Application Priority Data

Apr. 30, 1991 [JP] Japan ..... 3-126596

[51] Int. Cl.[5] ..... C21D 9/00

[52] U.S. Cl. ..... 266/96; 266/252

[58] Field of Search ..... 266/96, 249, 252; 432/239, 243

[56] References Cited

U.S. PATENT DOCUMENTS 3,553,414 1/1971 McArthur ..... 266/249

3,749,383 7/1973 Voigt et al. ..... 266/249

*Primary Examiner*—Scott Kastler

*Attorney, Agent, or Firm*—Ostrolenk Faber, Gerb & Soffen

[57] ABSTRACT

The heat treatment system includes a plurality of small-sized heat treating furnaces, having uniform heat treatment periods which are controlled to start the heat treatments in the respective furnaces with constant time lags. A lifting device is provided in front of the furnaces for introducing and discharging the workpieces. The lifting device is provided with a plurality of arms which project toward the furnaces, for supporting the workpieces. Untreated workpieces are stored in a front pool device and carried toward the lifting device by a conveyor, so that the lifting device inserts the workpieces into the furnaces. The workpieces, upon being completely heat treated, are removed from the furnace, moved downward onto the conveyor, and carried to a back pool device by the lifting device. The above series of operations are controlled by a single control unit.

9 Claims, 5 Drawing Sheets

HEAT TREATMENT SYSTEM

BACKGROUND OF THE INVENTION

1. Field of the Invention

The present invention relates to a heat treatment system, and more particularly, it relates to a heat treatment system which is employed for drying and baking protective resin layers of dip-coated electronic components, for example.

2. Description of the Background Art

FIG. 6 shows a holder W , called a separator, which is generally employed for dip-coating electronic components comprising plate-type lead terminals with protective resin. This holder W is adapted to hold a number of lead frames 51, to which electronic component elements 50 are mounted by soldering or the like, in parallel with each other. The holder W holding such lead frames 51 is so inverted as to dip the electronic component elements 50 in a dip-coating vessel, thereby forming protective resin layers 52 around the electronic component elements 50. Thereafter the holder W is carried toward a heat treating furnace, to dry and bake the protective resin layers 52.

In a conventional drying and baking step, a large-sized heat treating furnace of a batch system is employed for heat treating a number of holders at the same time. However, a waiting time is required for receiving the number of holders, which must be simultaneously introduced into the furnace, from a preceding step (dip-coating step), leading to inferior production efficiency. When pool means for temporarily storing such holders are provided in front and at the back of the furnace, it is possible to implement a continuous treating line thereby eliminating the waiting time. However, the capacity of each such pool means must correspond to at least the number of holders which can be simultaneously heat treated in the furnace. Thus, large spaces are required for installing such pool means, and much time is required for introducing the holders from the front pool means into the furnace and discharging the holders from the furnace to the back pool means.

In order to implement a continuous automatic treating line, as well as to simplify such operations for introducing and discharging the holders, it is possible to provide a conveyor type continuous heat treating furnace. The holders are continuously introduced into this furnace and moved therein upon a conveyor, to pass through a number of booths, with respective temperatures built in the furnace for a prescribed heat treatment.

However, since such a continuous heat treating furnace can obtain only a stepwise temperature profile, it is not suitable for the process of drying and baking protective resin layers, because a non-stepwise temperature increase profile is very important for this process. Moreover, when the line after the furnace is stopped for some reason, it is necessary to discharge all products which are contained in the furnace. Thus, a large pool means is required for storing such discharged products.

SUMMARY OF THE INVENTION

Accordingly, an object of the present invention is to provide a heat treatment system, which can be continuous with preceding and subsequent, treatment steps, and is capable of arbitrarily setting temperature profiles for heat treatments.

Another object of the present invention is to provide a heat treatment system which can reduce the sizes of pool means required at the front and at the back of heat treating furnaces.

The heat treatment system according to the present invention comprises a plurality of heat treating furnaces, each of which is adapted to simultaneously heat treat a constant number of workpieces. A control unit is adapted to control times for starting heat treatments in the respective furnaces with constant time lags, and to uniformly control treatment periods of the furnaces. Pool portions are provided in front and at the back of the furnaces: front pool means for storing untreated workpieces until they are introduced into the furnaces, and back pool means for storing treated workpieces until they are carried to a subsequent step. The workpieces completely treated in a furnace are discharged into the back pool means by a changing mechanism, then untreated workpieces stored in the front pool means are introduced into this vacant furnace by the changing mechanism.

In the inventive heat treatment system having the aforementioned structure, workpieces which are successively carried from a preceding step are first stored in the front pool means. The number of the workpieces thus stored in the front pool means is preferably set to be substantially equal to that of workpieces carried during the time lags for starting the heat treatment in each furnace. When a heat treatment is completed in any furnace, the workpieces contained therein are discharged into the back pool means, temporarily stored therein and then successively carried to a subsequent step. After the workpieces contained in this furnace are discharged into the back pool means, untreated workpieces are introduced into this vacant furnace from the front pool means. Thus, it is possible to substantially implement a continuous line from the preceding step to the subsequent step through the heat treating step.

According to the present invention, the heat treatment system may be formed by a plurality of small-sized furnaces, whereby it is possible to independently set temperature conditions in the respective furnaces. Thus, temperature profiles can be easily changed in response to materials. Further, laboratory conditions can be directly applied to mass production.

Further, a plurality of furnaces are employed so as to reduce the number of workpieces to be treated in each furnace, whereby the time required for introducing and discharging workpieces into and from each furnace can be reduced, also the changing mechanism, as well as the pool means can be reduced in size. Moreover, while one of the furnaces is stopped for receiving or discharging workpieces, the remaining ones are in driven states to cause no time loss, whereby it is possible to efficiently heat treat workpieces.

The workpieces can be automatically introduced into and discharged from the furnaces by lifter means, which is part of the changing mechanism. When the workpieces are completely dried and baked in a furnace, its door is opened and arms of the lifter means move up toward a portion in front of the open inlet, and the arms are inserted into the furnace to receive the workpieces. Then, the arms retract and move downward to transfer the workpieces onto a conveyor, which in turn transmits the workpieces into the back pool mean to make them ready for a subsequent step. After the treated workpieces have been transferred onto the conveyor, untreated workpieces carried from the front pool means are transferred onto the arms. The arms receiving the untreated workpieces move upward to carry them to the portion in front of the vacant furnace, and transfer the workpieces into the rack of the furnace. Thereafter the door of the furnace is closed, to start a heat treatment. Similar operations are thereafter successively repeated.

In order to attain efficient heat treatments by reducing time for introducing and discharging the workpieces into and from each furnace, it is preferable to provide a plurality of vertically arranged stages of racks in the furnace and to provide the lifter means with arms in the same number of stages as the racks. The plurality of workpieces which are supported by the arms in a parallel manner are horizontally introduced into the furnace, and the arms are slightly moved downward to transfer all workpieces onto the racks. In a similar manner, a plurality of workpieces can be simultaneously transferred from the furnace to the arms.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
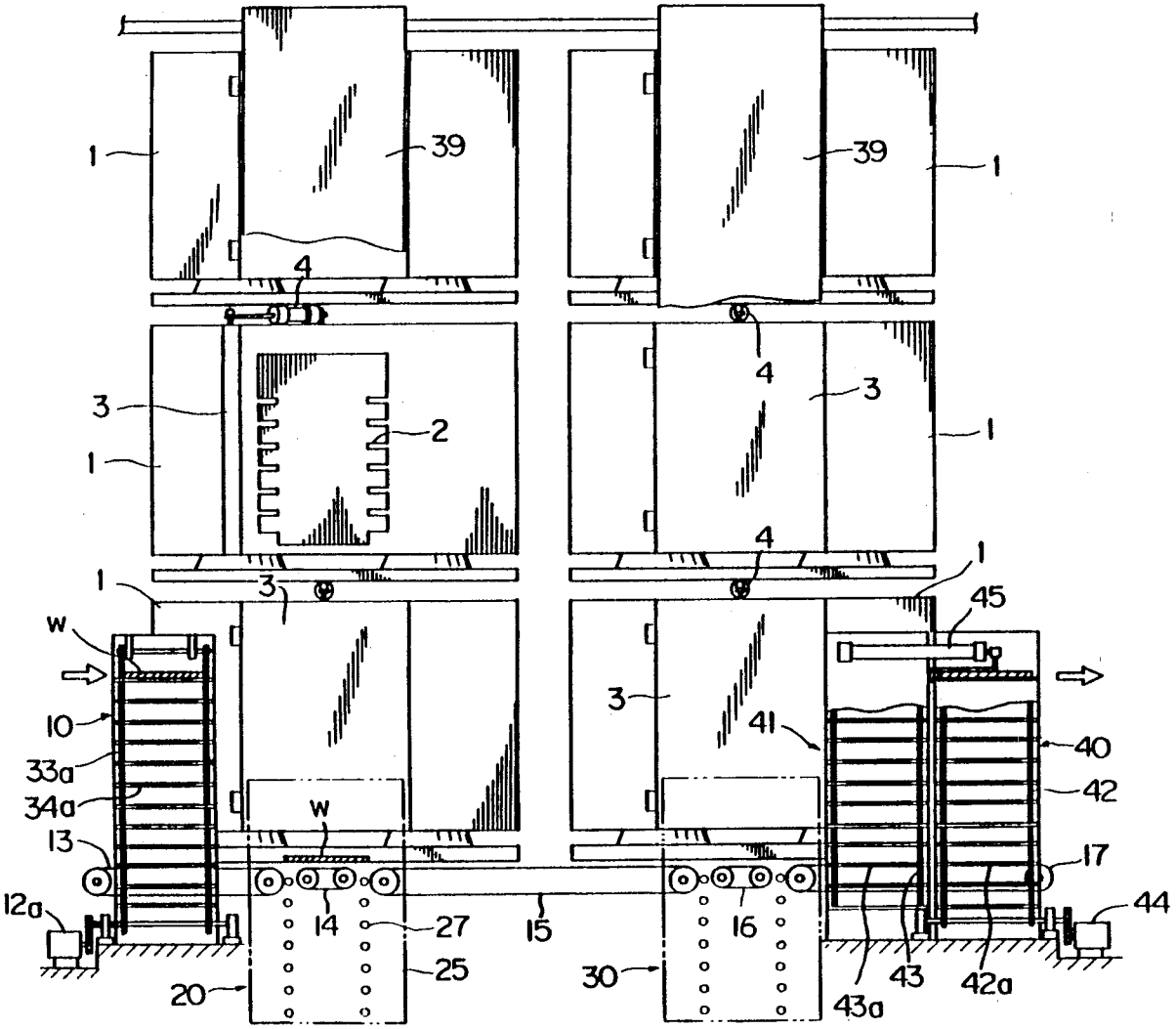
FIG. 1 is a front elevational view showing a heat treatment system according to the present invention.
Figure 2:
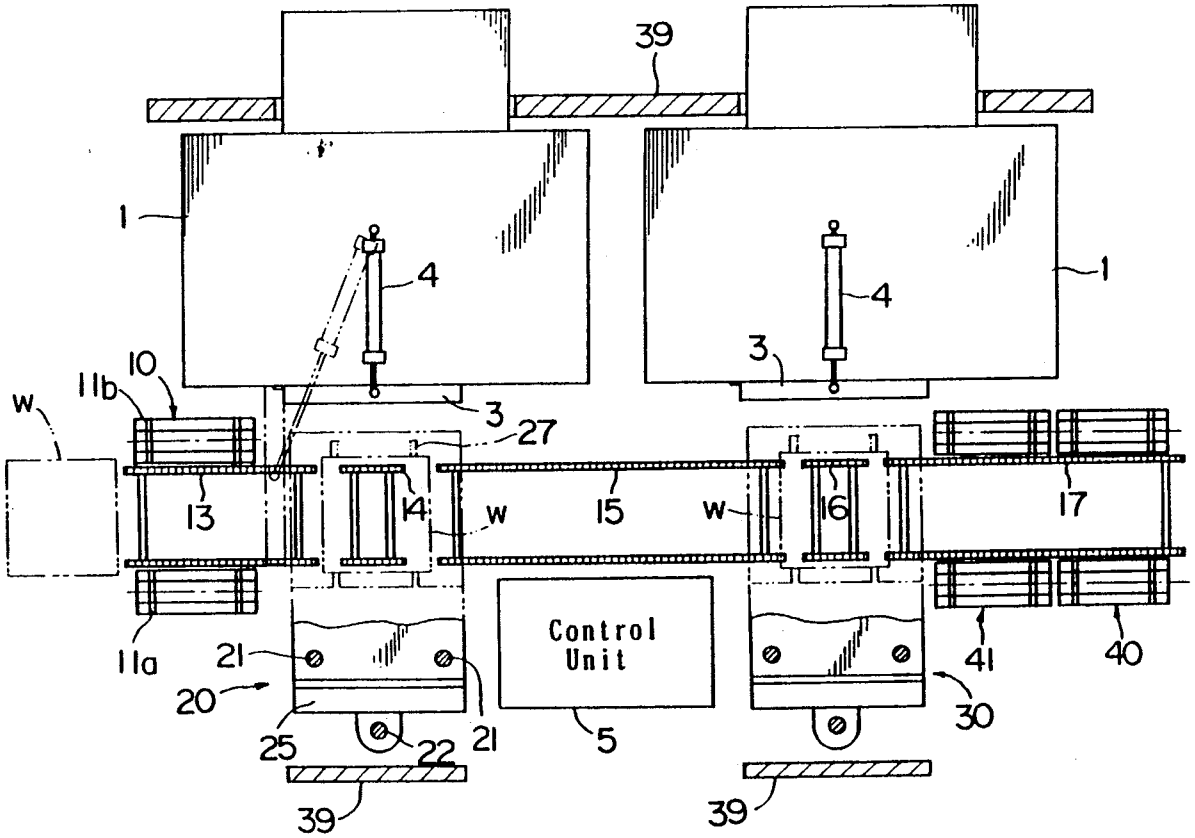
FIG. 2 is a plan view showing this heat treatment system.
Figure 3:
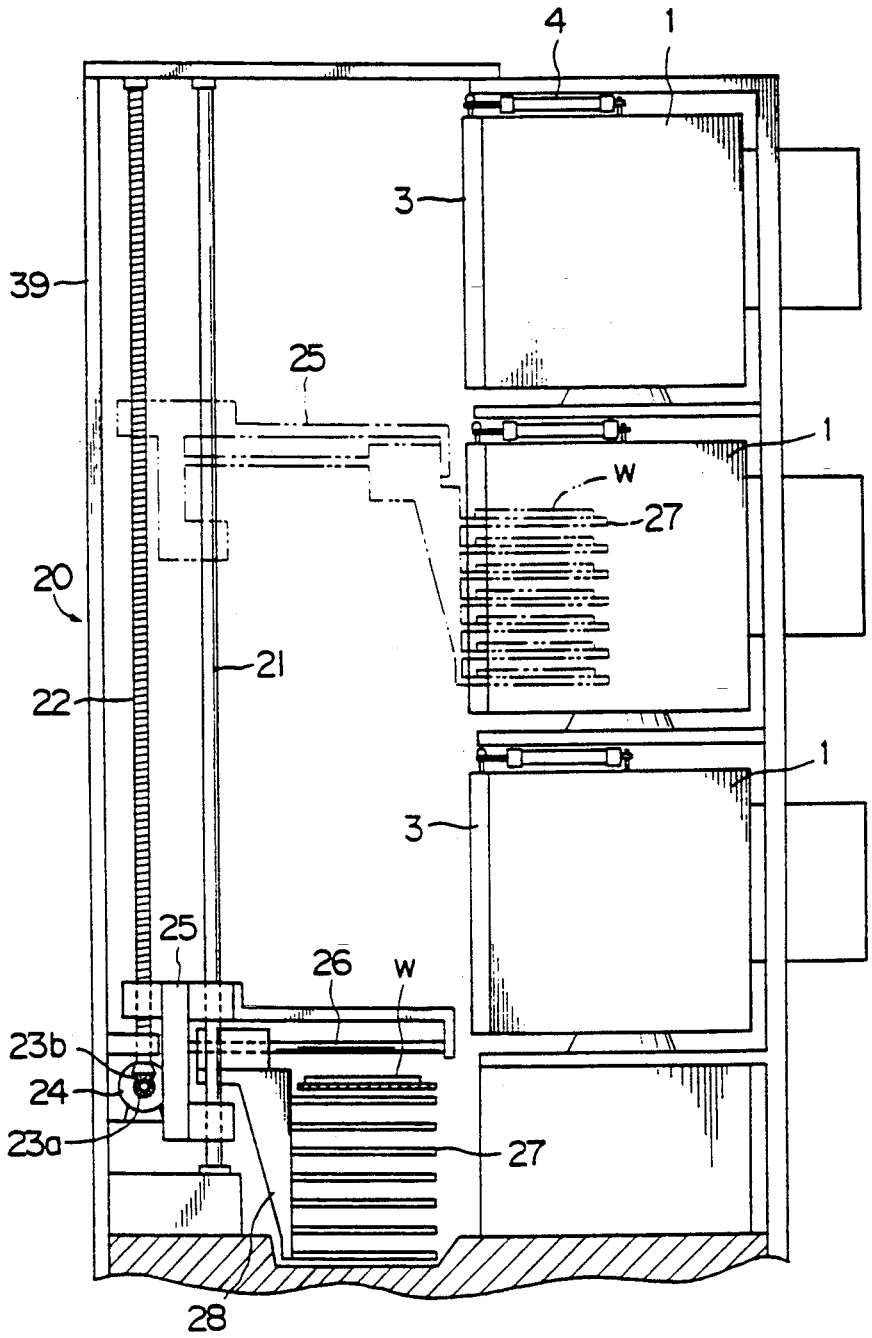
FIG. 3 is a right side elevational view showing the heat treatment system.

As shown in FIGS. 1 to 3, a heat treatment system according to the present invention is provided with six small-sized heat treating furnaces 1, which are arranged in two horizontal columns and three vertical stages. Each of the furnaces 1 is provided therein with seven support racks 2, to heat treat seven workpieces at the same time. Times for starting treatments of the furnaces 1, each having a treatment period of 150 minutes, are set with time lags of 25 minutes, so that the horizontal two columns of furnaces 1 alternately start the heat treatments. The furnaces 1 are independently temperature-controlled by a control unit 5, which also manages the treatment periods. Each furnace 1 is provided on its front surface with a door 3, which can be opened and closed by a hydraulic cylinder 4 provided on the upper surface of the furnace 1. This hydraulic cylinder 4 is also controlled by the control unit 5.

Figure 4:
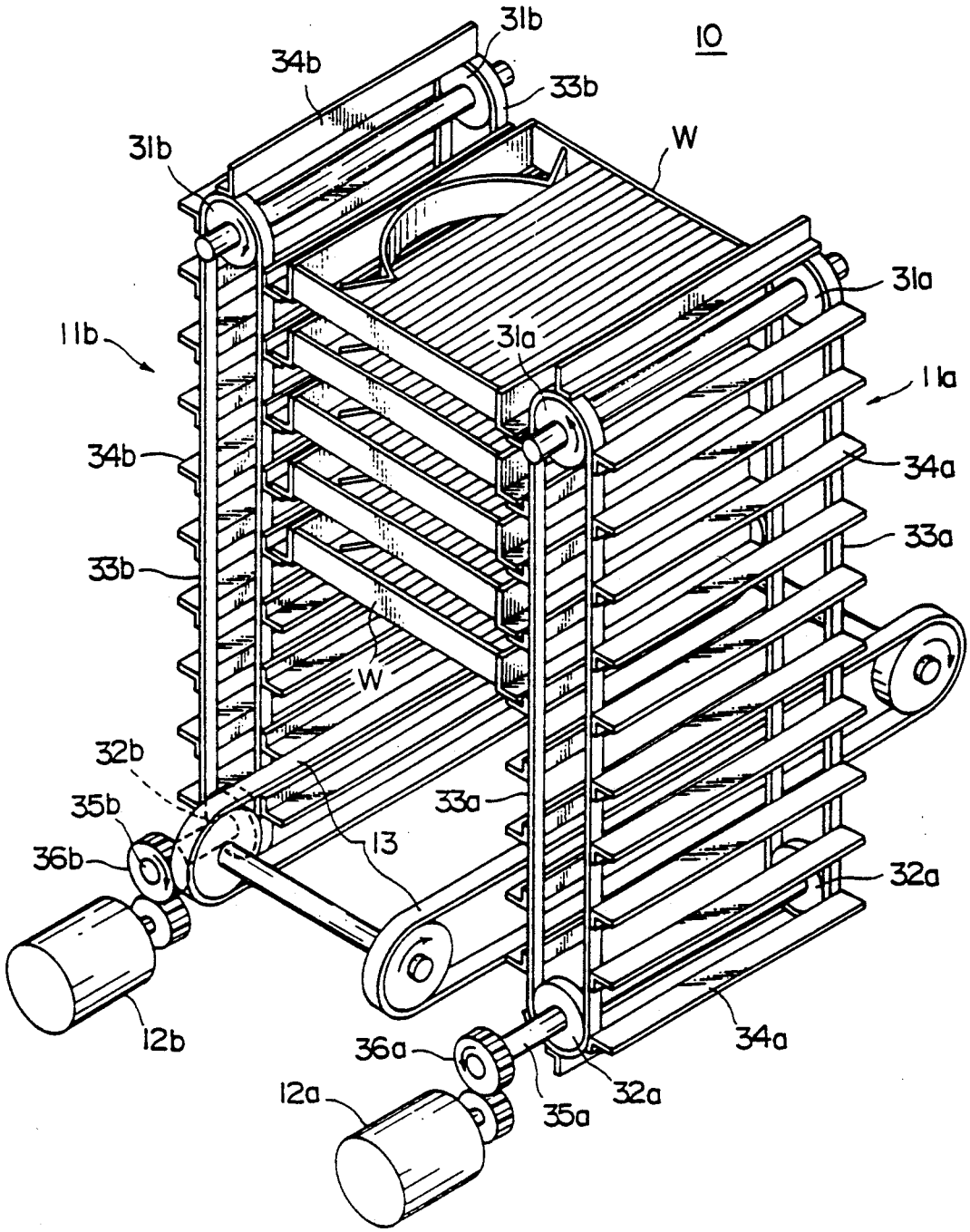
FIG. 4 is a perspective view showing a front pool means.
Figure 6:
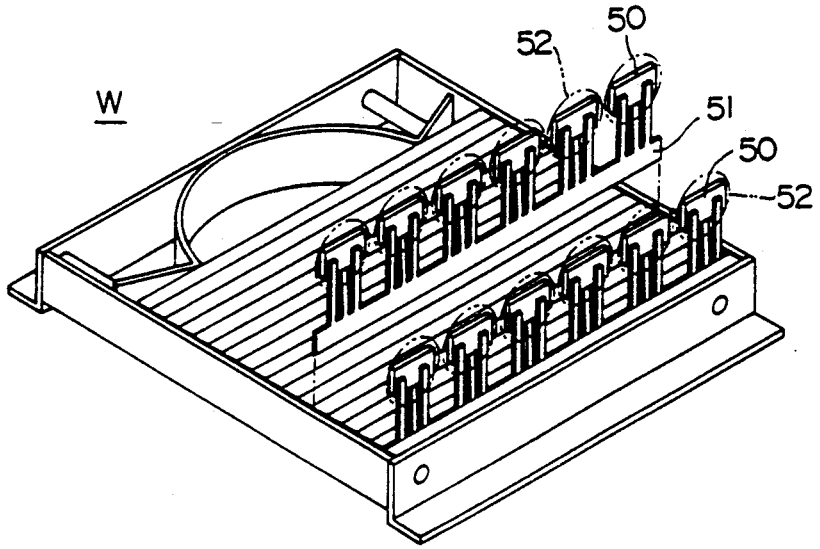
FIG. 6 is a perspective view showing an exemplary workpiece.

As shown in FIG. 4, a front pool means 10 is provided in front of the furnaces 1, in order to store workpieces W (see FIG. 6) which are carried one by one from a preceding step (dip coating step) every constant period. Referring to FIG. 4, no electronic components are illustrated in relation to the workpieces W. The front pool means 10 is formed by a pair of lowering means 11*a* and 11*b*, which are arranged on both sides of conveyor means 13. The lowering means 11*a* comprises a pair of endless chains 33*a* and plural L-shaped supports 34*a* attached between the chains at constant pitches to support one side of the workpieces W. Endless chains 33*a* are driven by two pairs of sprockets 31*a* and 32*a* being vertically arranged. In a similar manner, the lowering means 11*b* comprises endless chains 33*b* with supports 34*b*, which are driven by two pairs of sprockets 31*b* and 32*b*. Gears 36*a* and 36*b* are fixed on front ends of shafts 35*a* and 35*b* of the lower sprockets 32*a* and 32*b* respectively, so that the gears 36*a* are 36*b* are intermittently driven by motors 12*a* and 12*b* synchronously in reverse directions. When dip-coated workpieces W are inserted one by one in the upper end portion of the front pool means 10, the workpieces are supported horizontally by the supports 34*a* and 34*b*, and moved down by constant pitches, thereby they are transferred to the conveyor means 13 in positions close to the lowest part of the front pool means 10.

A changing mechanism is formed by conveyor means 13 to 17 and lifter means 20 and 30. The workpieces W transferred onto the conveyor means 13 are horizontally carried and stopped either on a short conveyor means 14 provided in front of the front column of the furnaces 1, or on a short conveyor means 16 provided in front of the rear column of the furnaces 1 through the conveyor means 14 and 15. The short conveyor means 14 and 16 are shorter in length than the workpieces W along the direction of carriage.

Figure 5:
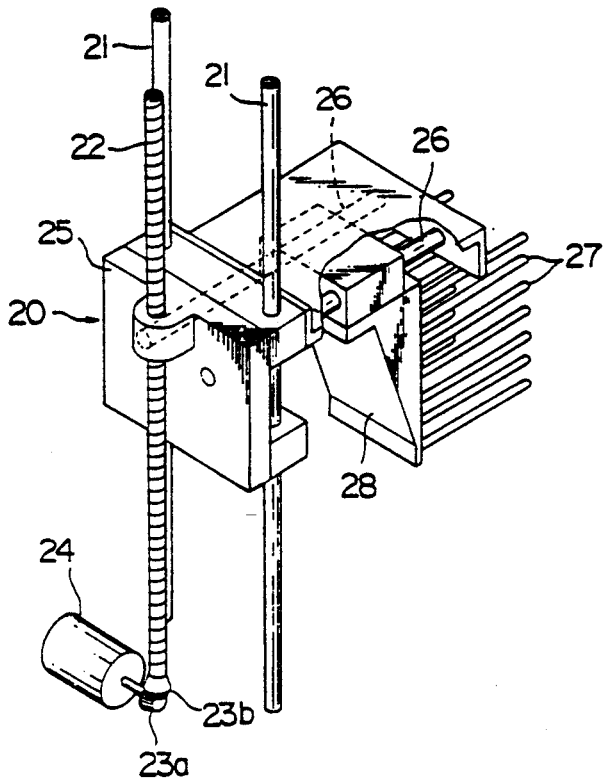
FIG. 5 is a perspective view showing an essential portion of lifter means.

As shown in FIG. 5, the lifter means 20 and 30 are provided in portions corresponding to the short conveyor means 14 and 16 respectively. The rear lifter means 30 is absolutely similar in structure to the front lifter means 20, which is now exclusively described. Since the horizontal two columns of the furnaces 1 are set to alternately start the heat treatments, the front and rear lifter means 20 and 30 are also alternately driven. The lifter means 20 comprises two guide shafts 21 which are vertically arranged with respect to a frame 39, a rotatable ball screw shaft 22 which is supported in parallel with the guide shafts 21, a motor 24 for driving the ball screw shaft 22 through bevel gears 23*a* and 23*b*, and a lifter member 25 slidably guided by the guide shafts 21 and fitted with the ball screw shaft 22.

The lifter member 25 comprises a pair of rodless cylinders 26, which are adapted to horizontally drive an arm support member 28. Seven horizontal pairs of fork-type arms 27 project toward the furnaces in seven stages arranged in the vertical direction from a surface of the support member 28 facing the furnaces 1. The horizontal spaces between the pairs of arms 27 are larger in length than the short conveyor means 14 along the direction of carriage, and the arms 27 are vertically movable through clearances between the long conveyor means 13 and 15 and the short conveyor means 14. Thus, the arms 27 can transfer the workpieces W from and to the short conveyor means 14. The lifter member 25 is located at the lowest position when the first one of the workpieces W is carried thereto, and is stepwisely moved up every time a single workpiece W is carried, so that seven workpieces W are finally supported by all arms 27.

After seven workpieces W are supported by all arms 27, the ball screw shaft 22 is rotated by the motor 24, so that the lifter member 25 is moved up to a portion in front of a vacant furnace 1, whose door 3 is already opened. The cylinder 26 is so driven as to insert the arms 27 into the furnace 1. Then the lifter member 25 is slightly moved down from this state, so that both end portions of the workpieces W are supported by the racks 2 provided in the furnace 1. After the workpieces W are transferred onto the racks 2, the arms 27 are retracted and the lifter member 25 is moved down to the original position, i.e. below the conveyor means 14. After the lifter member 25 is thus moved down, the control unit 5 makes cylinder 4 close the door 3, to start the heat treatment.

When heat treatment is completed in any furnace 1, its door 3 is opened and the lifter member 25 is moved up to a position in front of this furnace 1 in a similar manner to the above, and inserts the arms 27 into the furnace. Then the lifter member 25 is slightly moved upward to receive the workpieces W from the racks 2 in the arms 27, which in turn are retracted. Then the lifter member 25 is moved downward to the position of the conveyor 14, and the workpieces W are transferred one by one onto the conveyor means 14 from the lower arms 27, horizontally carried by the conveyor means 14, as well as the conveyor means 15, 16 and 17, and transferred to the back pool means 40.

As shown in FIG. 1, two back pool means 40 and 41 are provided, both similar in structure to the front pool means 10. The back pool means 40 is formed by a pair of lifting means which are arranged on both sides of conveyor means 17. This lifting means comprises many L-shaped horizontal supports 42*a* lead by a pair of chains 42 at its both side ends. Chains 42 are synchronously driven by motors 44 to raise up the workpieces placed on the conveyor 17 by supporting both ends thereof, to discharge the workpieces W one by one from the top of the chains 42 to a subsequent step by cylinders 45. Another back pool means 41 has the same structure and works in the same way as pool means 40. Although FIG. 1 shows only a single motor 44 and a single cylinder 45, such elements are independently provided on the respective back pool means 40 and 41.

The front and back pool means 10, 40 and 41, the conveyor means 13 to 17, the lifter means 20 and 30, and the like are integrally controlled by the control unit 5.

Suppose that the heat treatment system of this embodiment is provided with six furnaces each having a treatment hour of 150 minutes for heat treating seven workpieces, and these furnaces start heat treatments with time lags of 25 minutes. Assuming that the first furnace completes its heat treatment at a time $t=0$ and that a time required for discharging and introducing workpieces is 4 minutes, this furnace starts a next heat treatment at a time $t=4$ minutes. Thereafter the second furnace completes its heat treatment at a time $t=25$ minutes, and starts a next heat treatment at a time $t=29$ minutes. Similarly, the third furnace completes its heat treatment at a time $t=50$ minutes, and starts a next heat treatment at a time $t=54$ minutes. Thereafter the fourth, fifth and sixth furnaces successively complete heat treatments, and start next heat treatments after the workpieces are discharged from and introduced into these furnaces.

In aforementioned heat treatment system, $6\times7=42$ workpieces are heated during a time interval of 154 minutes. For the purpose of comparison, a large-sized batch furnace, having a treatment period of 150 minutes, can simultaneously heat treat 42 workpieces. When workpieces are discharged from and introduced into this batch furnace by the above changing mechanism, 24 minutes are required for discharging and introducing 42 workpieces, through simple calculation, since 4 minutes are required for discharging and introducing seven workpieces. Although it is possible to simultaneously introduce and discharge 42 workpieces into and from this batch furnace, the size of the changing mechanism must be enlarged in this case. On the other hand, the present invention requires 4 minutes to discharge and introduce 42 workpieces as a whole since five furnaces are driven while one furnace is stopped for discharging and introducing workpieces. In other words, it is possible to reduce the time for introducing and discharging the workpieces to about 1/6 according to the present invention, as compared with the large-sized batch furnace. Moreover, according to the present invention, it becomes possible to employ a small-sized changing mechanism, as well as to reduce the time for discharging and introducing workpieces.

The present invention is not restricted to the above embodiment but may be modified in various ways, as a matter of course. For example, the heat treatment system according to the present invention is applicable not only to a step of drying and baking electronic components, but to a heat treatment of all other articles. However, it is effective to apply the present invention to a heat treatment of miniature products which are manufactured in a continuous line.

Although about seven workpieces can be stored in the front pool means and about 14 workpieces can be stored in the back pool means in the aforementioned embodiment, the numbers of workpieces storable in the pool means can be arbitrarily changed in consideration of relationships between treating speeds of the heat treating step and the precedent and subsequent steps. The structures of the front and back pool means are not restricted to those comprising the chains provided with supports as shown in the embodiment, but pool means may alternatively comprise plural rack frames which are vertically moved while supporting both end portions of workpieces.

The conveyor means employed in the present invention are not restricted to the belt conveyor means appearing in the embodiment, but it may alternatively comprise tables traveling along rails.

The arrangement of the furnaces according to the present invention are not restricted to the two columns and three stages appearing in the embodiment, as a matter of course. Further, the number of workpieces simultaneously treated by each furnace is not restricted to seven.

Further, even in the case that the furnaces are arranged in two or more horizontal columns as appearing in the embodiment, if a lifter means is able to move horizontally along the conveyor means, it is sufficient to provide only one unit of lifter means for changing the workpieces.

Furthermore, instead of the lifter means appearing in the embodiment, an X-Y robot (which can move both vertically and horizontally) can be used for changing the workpieces.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat treatment system for continuously heat treating a plurality of workpieces, said heat treatment system comprising:

a plurality of heat treatment furnaces, each of said furnaces being capable of simultaneously heat treating a constant number of said workpieces;

a control unit for starting heat treatments in said respective furnaces with constant time lags and for uniformly controlling treatment periods of said furnaces;

a front pool means for storing said workpieces before said workpieces are introduced into said furnaces;

a back pool means for storing said workpieces after said workpieces have been heat treated in said furnaces; and a changing mechanism for discharging said workpieces being heat treated in said furnaces to said back pool means and for introducing said workpieces being stored in said front pool means into said furnaces said changing mechanism comprising first conveyor means for removing said workpieces being stored in said front pool means, one by one from said front pool means; lifter means for receiving said workpieces being carried by said first conveyor means for introducing said workpieces into said furnaces; and second conveyor means for receiving said workpieces being removed from said furnaces by said lifter means and for carrying said workpieces to said back pool means.

2. A heat treatment system in accordance with claim 1, wherein said plurality of furnaces are vertically arranged in a plurality of columns along the direction of carriage through said first and second conveyor means, and said lifter means are provided in correspondence the respective columns of said furnaces.

3. A heat treatment system in accordance with claim 1, wherein said lifter means comprises a plurality of arms extending toward inlets of said furnaces for horizontally supporting said workpieces one by one, and said workpieces can be introduced into and discharged from said furnaces by vertical and horizontal movement of said arms.

4. A heat treatment system in accordance with claim 3, wherein said arms are formed by horizontal pairs of fork arms projecting toward said furnaces at regular intervals, and third conveyor means, being smaller in length than said intervals located between said arms, is provided in a position below said lifter means, so that said workpieces are transferred from said third conveyor means onto said arms upon upward movement of said arms, and said workpieces are transferred from said arms onto said third conveyor means upon downward movement of said arms.

5. A heat treatment system in accordance with claim 3, wherein a plurality of stages of racks for horizontally supporting said workpieces are provided in each of said furnaces along the vertical direction at regular intervals, and said arms are provided in the same number as said stages of racks and at the same regular intervals.

6. A heat treatment system in accordance with claim 3, wherein said lifter means comprises:

a vertical guide shaft;

a ball screw shaft being provided in parallel with said guide shaft;

a motor for driving said ball screw shaft;

a lifter member being slidably engaged with said guide shaft and fitted with said ball screw shaft; and a cylinder being mounted on said lifter member for horizontally moving said arms.

7. A heat treatment system in accordance with claim 1, wherein said front pool means comprises:

a vertical pair of endless chains provided on both sides of said first conveyor means;

a motor for synchronously driving said pair of chains in directions reverse to each other; and supports for supporting both end portions of said workpieces mounted said respective pair of said chains.

8. A heat treatment system in accordance with claim 1, wherein said back pool means comprises:

a vertical pair of endless chains provided on both sides of said second conveyor means;

a motor for synchronously driving said chains in directions reverse to each other; and supports for supporting both end portions of said workpieces mounted said on respective pair of said chains.

9. A heat treatment system in accordance with claim 1, wherein said front pool means is capable of storing said workpieces in a number corresponding to the number of said workpieces being treated by each of said furnaces.

* * * * *